US011077440B2

(12) United States Patent
Flory et al.

(10) Patent No.: US 11,077,440 B2
(45) Date of Patent: Aug. 3, 2021

(54) METHODS AND APPARATUS TO FACILITATE GRAVITATIONAL CELL EXTRACTION

(71) Applicant: Agilent Technologies, Inc., Santa Clara, CA (US)

(72) Inventors: Curt A. Flory, Los Altos, CA (US); Dustin Chang, Mountain View, CA (US); Pallevi Srivastva, Santa Clara, CA (US); Rolfe Anderson, Saratoga, CA (US)

(73) Assignee: AGILENT TECHNOLOGIES, INC., Santa Clara, CA (US)

( * ) Notice: Subject to any disclaimer, the term of this patent is extended or adjusted under 35 U.S.C. 154(b) by 203 days.

(21) Appl. No.: 16/460,551

(22) Filed: Jul. 2, 2019

(65) Prior Publication Data

US 2020/0023364 A1 Jan. 23, 2020

Related U.S. Application Data

(60) Provisional application No. 62/699,710, filed on Jul. 17, 2018.

(51) Int. Cl.
*B01L 3/00* (2006.01)

(52) U.S. Cl.
CPC ..... *B01L 3/502761* (2013.01); *B01L 3/50273* (2013.01); *B01L 3/502746* (2013.01); *B01L 2200/027* (2013.01); *B01L 2200/0668* (2013.01); *B01L 2200/143* (2013.01); *B01L 2300/0663* (2013.01); *B01L 2300/14* (2013.01); *B01L 2400/0487* (2013.01)

(58) Field of Classification Search
CPC ..... B01L 3/502761; B01L 3/50273; B01L 3/502746; B01L 2200/027; B01L 2200/0668; B01L 2300/0663; B01L 2300/14; B01L 2400/0487
See application file for complete search history.

(56) References Cited

FOREIGN PATENT DOCUMENTS

WO WO-2008055915 A2 * 5/2008 ..... B01L 3/502738

OTHER PUBLICATIONS

Huh et al., Gravity-Driven Microfluidic Particle Sorting Device with Hydrodynamic Separation Amplification, Feb. 15, 2007, Analytical Chemistry, vol. 79, No. 4, 1369-1376 (Year: 2007).*
Pamme, N., "Continuous flow separations in microfluidic devices," Lab Chip, 2007, vol. 7, pp. 1644-1659.

* cited by examiner

*Primary Examiner* — Jennifer Wecker
*Assistant Examiner* — Kathryn Elizabeth Limbaugh

(57) ABSTRACT

The invention relates generally to methods and apparatus that gravitationally transfer cells from a first medium to a second medium. More specifically, the invention relates to a novel microfluidic device. The microfluidic device includes a cell transfer region, a cell settling channel, a waste channel, a cell output channel, and an input medium channel. The cell settling channel, the waste channel, and the cell output channel extend from, are in fluid communication with, and are smaller in cross section than the cell transfer region. The cell output channel is substantially perpendicular to the cell settling channel and to the waste channel. The input medium channel extends from and is in fluid communication with the cell output channel.

20 Claims, 6 Drawing Sheets

METHODS AND APPARATUS TO FACILITATE GRAVITATIONAL CELL EXTRACTION

CROSS-REFERENCE TO RELATED APPLICATIONS

This application claims the benefit of U.S. Provisional Application No. 62/699,710, filed Jul. 17, 2018, which application is incorporated by reference herein.

FIELD OF THE INVENTION

The invention relates generally to methods and apparatus used to perform measurements on living cells. More specifically, the invention relates to a novel microfluidic device that transfers livings cells from a cell culture medium to another medium, such as a measurement medium.

BACKGROUND OF THE INVENTION

Measurements and experiments done on living cells usually require the cells to be in a healthy state before commencement of a given assay. Employment of cells with unknown or compromised health and viability does not allow the research biologist to accurately study the functional attributes and characteristics of normal healthy cells, nor does it allow a clear assessment of the response of cells to applied drugs or other perturbative stimuli. As a result, the cells under study must be kept in a culture medium conducive to a healthy state, right up to the moment where a particular measurement is to be performed. Typical media used to keep cells in a healthy state contain various nutrients and electrolytes at specified levels (e.g., sugar, salt, etc.). Oftentimes, measurements on cells or components thereof involve molecular determination of the cell contents using instrumentation incompatible with the culture medium used to keep the cells in a healthy state. For example, some mass spectrometers will not produce accurate measurements on samples of fluid having a salt concentration of 10 or more millimolar, which is typical of cells suspended in a culture medium.

Techniques that exist to transfer cells from a culture medium into a medium compatible with a measurement process are generally slow, especially on the scale of biological metabolic processes. A typical bulk process is centrifugation, where the medium containing the target cells is placed in a centrifuge, and the denser cells are accumulated in a small volume at the bottom of the container. The culture medium can then be removed and replaced by the desired fluid. The time scale for this process is minutes—slow for biological metabolic processes—and the resultant suspended cells must still be injected into the workflow for the measurement, further increasing the time the cells must exist in a non-viable medium before measurement. Another approach is to leave the cells within the native culture medium and attempt to remove the molecular components from that fluid that are incompatible with the measurement process. In this molecular removal approach, the target cells and the culture medium in which they are suspended pass through a microfluidic system integrated into the measurement workflow where the culture medium undergoes dialysis or diafiltration to remove the unwanted molecules (e.g., salt, sugar, etc.). This process involves the selective diffusion of the unwanted molecules through a semi-permeable membrane, where the molecular weight cut-off of the membrane is determined by the size of its pores. This process is also relatively slow for typical biologically relevant molecule concentrations and microfluidic dimensions required by cell diameters (e.g., minutes).

Therefore, a system that extracts cells from a culture medium, injects the cells into a sample medium, and operates on a time scale that is short with respect to biological metabolic processes is desired.

SUMMARY OF THE INVENTION

These and other features and advantages of the present methods and apparatus will be apparent from the following detailed description, in conjunction with the appended claims.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DETAILED DESCRIPTION OF THE INVENTION

Figure 1:
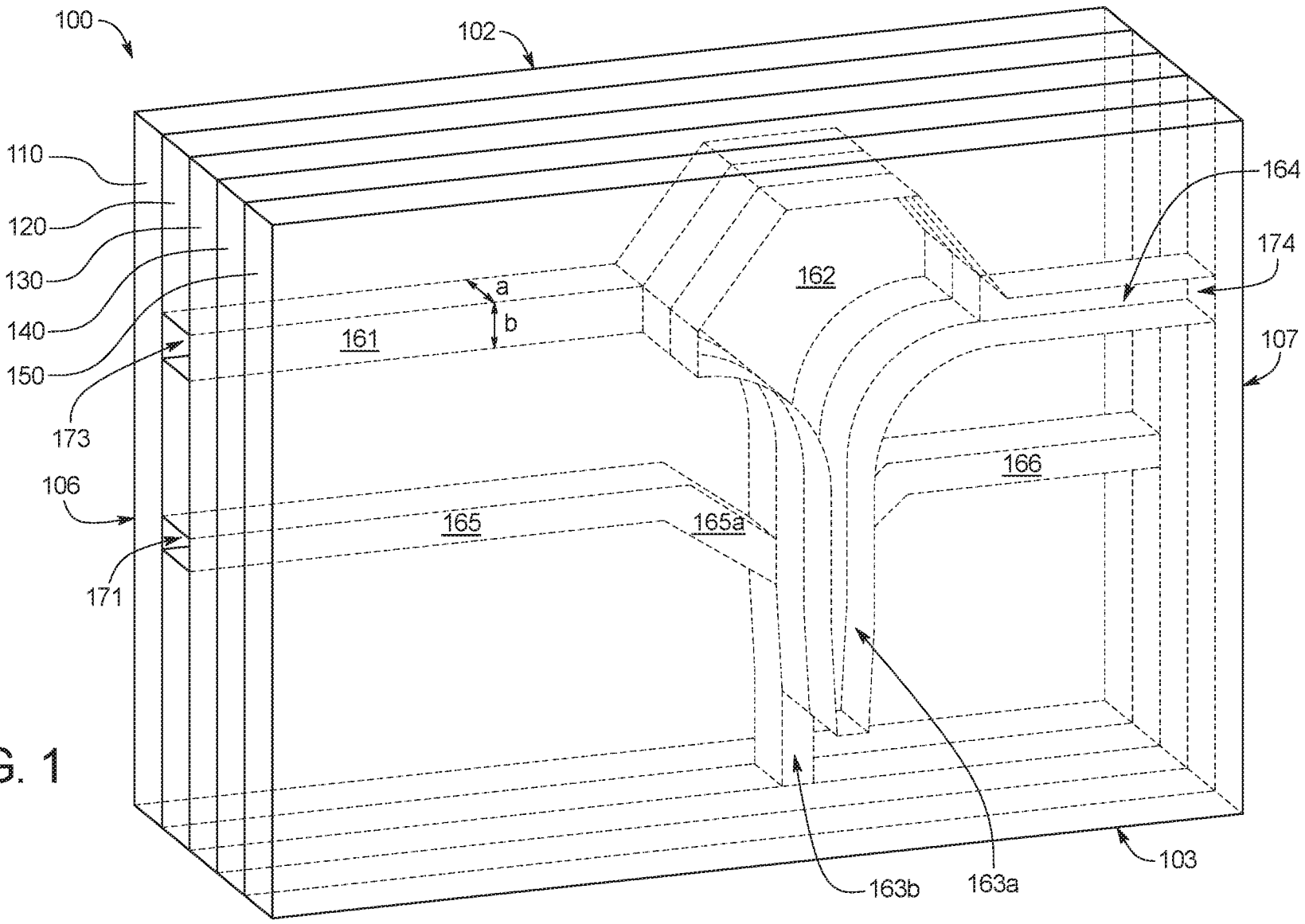
FIG. 1 is a perspective view of a microfluidic device in accordance with the teachings of this disclosure.

It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

Definitions

As used herein, and in addition to their ordinary meanings, the terms "substantial" or "substantially" mean to within acceptable limits or degree to one having ordinary skill in the art.

As used herein, the terms "approximately" and "about" mean to within an acceptable limit or amount to one having ordinary skill in the art. The term "about" generally refers to plus or minus 15% of the indicated number. For example, "about 10" may indicate a range of 8.5 to 11.5. For example, "approximately the same" means that one of ordinary skill in the art considers the items being compared to be the same.

In the present disclosure, numeric ranges are inclusive of the numbers defining the range. It should be recognized that chemical structures and formula may be elongated or enlarged for illustrative purposes.

Before the various embodiments are described, it is to be understood that the teachings of this disclosure are not limited to the particular embodiments described, and as such can, of course, vary. It is also to be understood that the terminology used herein is for the purpose of describing particular embodiments only, and is not intended to be limiting, since the scope of the present teachings will be limited only by the appended claims.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present teachings, some exemplary methods and materials are now described.

All patents and publications referred to herein are expressly incorporated by reference.

As used in the specification and appended claims, the terms "a," "an," and "the" include both singular and plural referents, unless the context clearly dictates otherwise. Thus, for example, "a moiety" includes one moiety and plural moieties.

Microfluidic Device

As one aspect of the present invention, a microfluidic device (e.g., a microfluidic chip) is provided that comprises a long cell settling channel where cells suspended in a first medium, such as a flowing cell medium, settle to the lower portions of the channel due to gravitational effects followed by a cell transfer region where the first medium flow is divided into first and second portions. The first portion of the first medium and most of the cells are directed downward into a proximal but separate cell output channel that receives an input medium flowing toward the next stage of the measurement workflow (e.g., a mass spectrometry stage). The remaining second portion of the first medium (e.g., a waste medium) continues out a waste channel. In some embodiments the first portion of the first medium is small (e.g., 10 percent of the undivided first medium flow) as compared to the remaining second portion.

The dimensions of the microfluidic device and flow rates of the first medium and the input medium are chosen such that fluid movements of the media are laminar. Cells immersed in the first medium enter a long cell settling channel. Because the cells are more dense than the surrounding first medium, gravity causes the cells to settle to the bottom laminae of the laminar flow along the cell settling channel. As the cells and first medium enter the cell transfer region, each laminar streamline is diverted to either the cell output channel or the waste channel. Depending upon the relative back pressures of the waste channel and cell output channel, more of the first medium, or less of the first medium and cells can be directed to the cell output channel. Because of laminar flow dynamics, the first laminae to be directed into the cell output channel are those at the bottom of the cell settling channel. As the waste channel back pressure is increased, sequentially higher laminae in the cell settling channel are diverted to the cell output channel. Given a sufficiently long (e.g., 2 centimeters, etc.) cell settling channel, most of the cells will have settled (e.g., fallen) into the lowest laminae of the laminar flow and a majority of those settled cells will be transferred to the cell output channel with a minimal transfer of the original unwanted first medium. In some embodiments, the transfer of a cell from the first medium to the second medium takes place on a time scale of seconds. The cells in the second medium are then directed via the cell output channel to the next stage of a microfluidic platform designed to effect a specified measurement protocol.

Figure 2A:
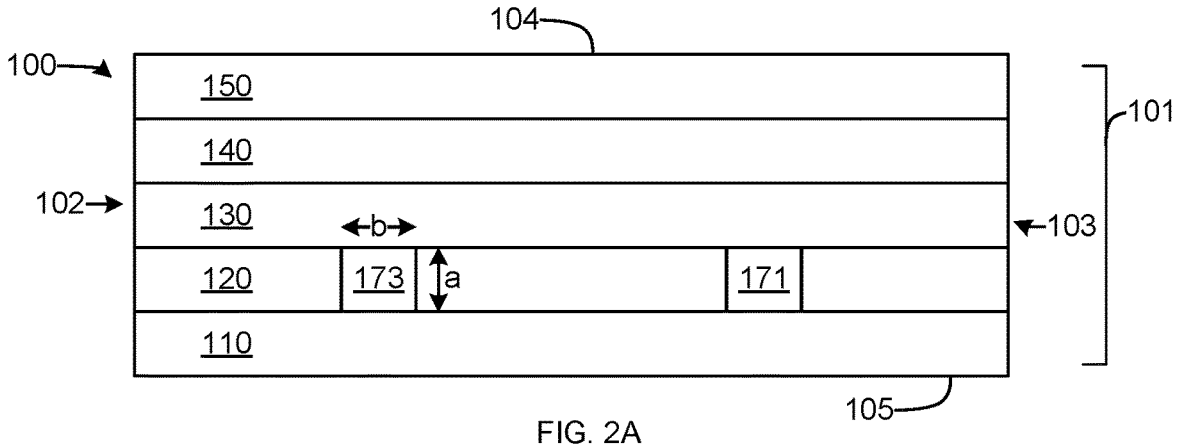
FIG. 2A is a side view of the microfluidic device of FIG. 1.
Figure 2B:
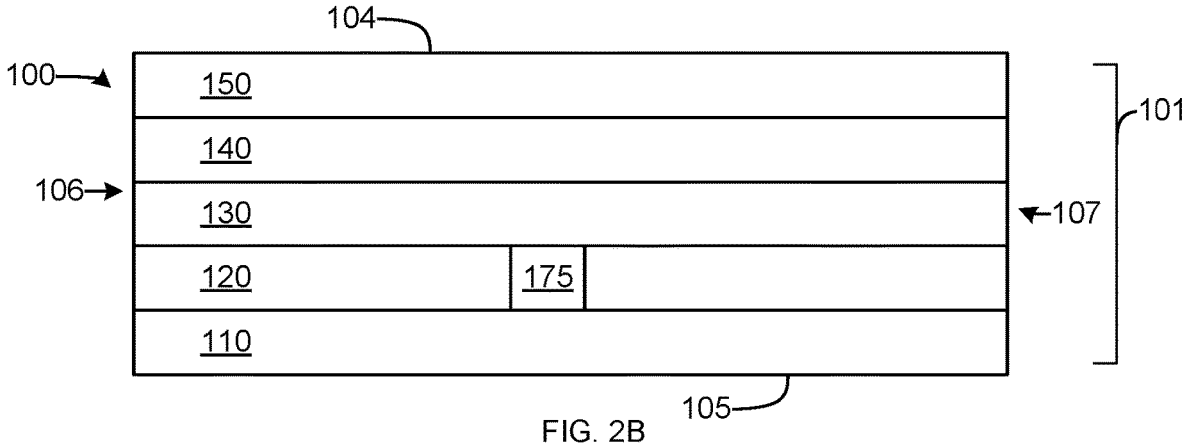
FIG. 2B is a bottom view of the microfluidic device of FIG. 1.
Figure 2C:
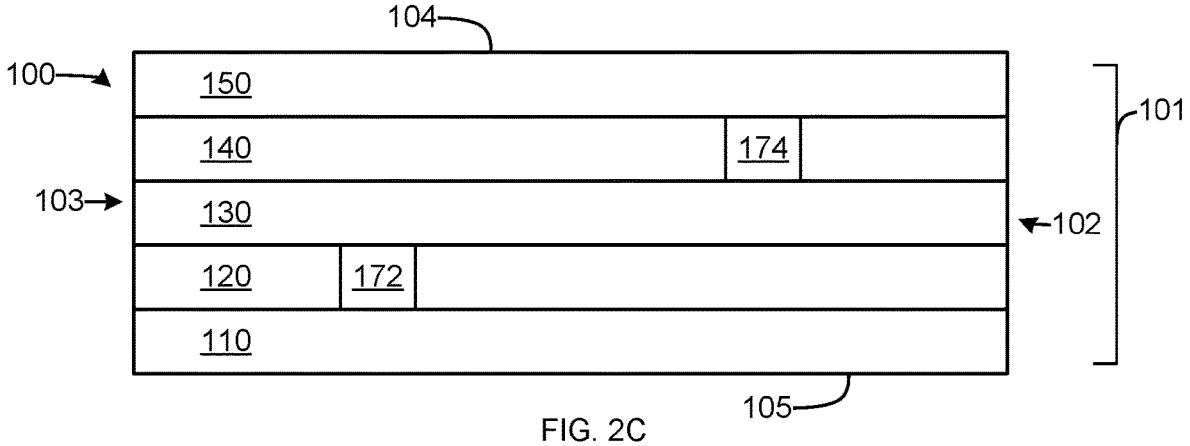
FIG. 2C is another side view of the microfluidic device of FIG. 1.
Figure 3A:
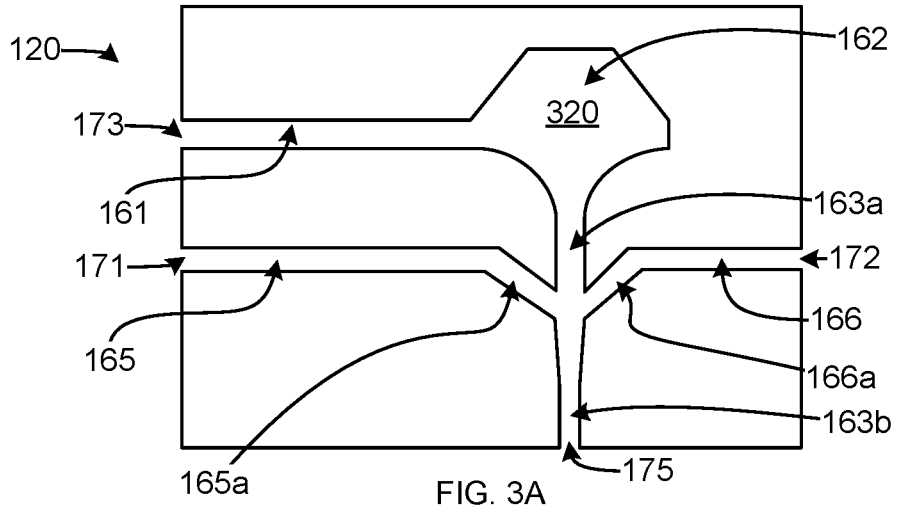
FIG. 3A is a front view of a second layer the microfluidic device of FIG. 1.
Figure 3B:
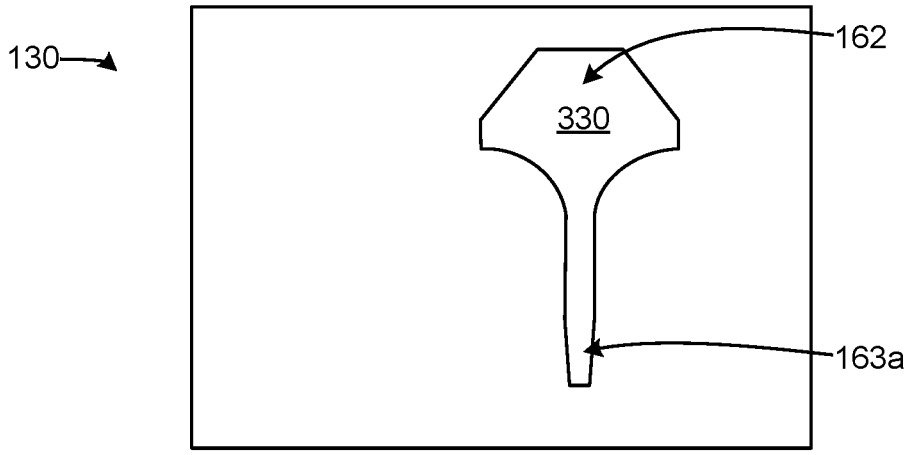
FIG. 3B is a front view of a third layer the microfluidic device of FIG. 1.
Figure 3C:
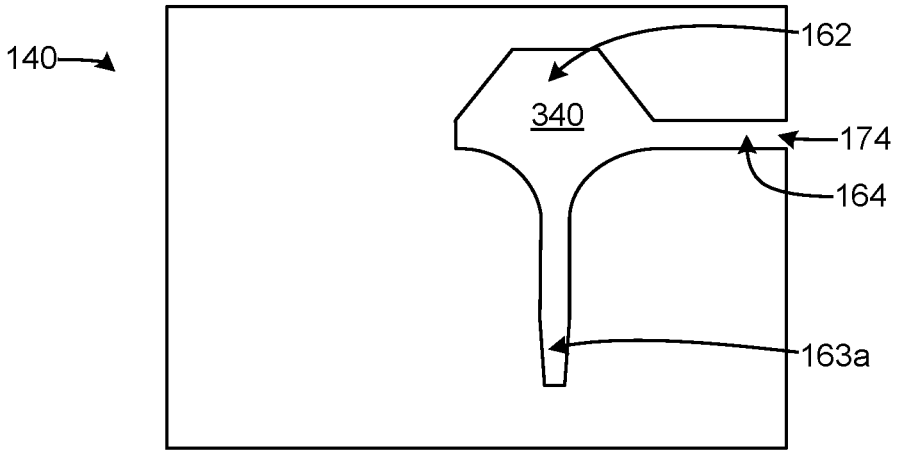
FIG. 3C is a front view of a fourth layer the microfluidic device of FIG. 1.
Figure 4:
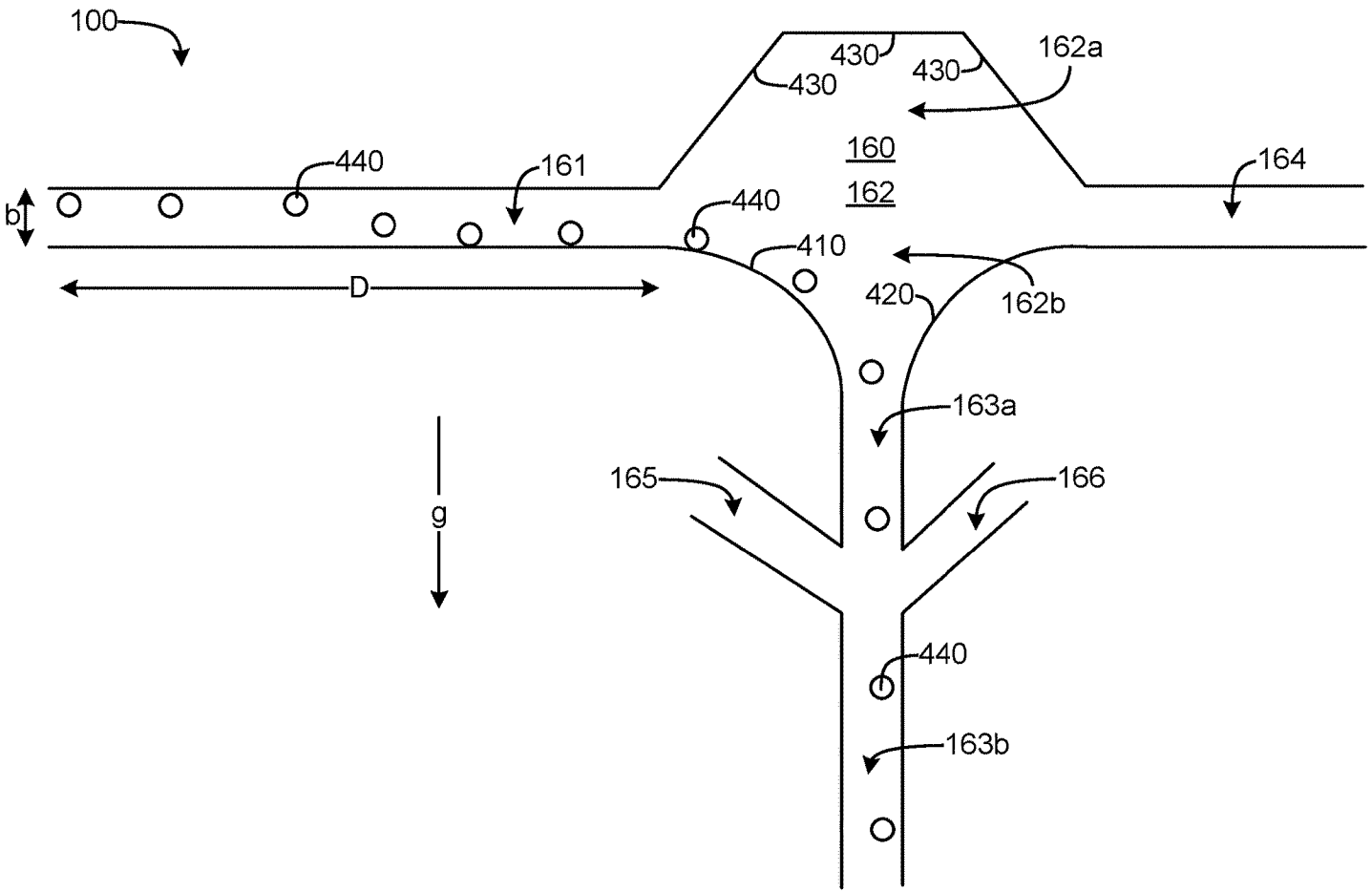
FIG. 4 is a schematic cross sectional view of the microfluidic device of FIG. 1.

FIG. 1 is a perspective view of an embodiment of a microfluidic device 100. FIGS. 2A, 2B, and 2C are first side, bottom, second side views, respectively of the microfluidic device 100. FIGS. 3A, 3B, and 3C are front views of a second layer 120, a third layer 130, and a fourth layer 140 of the microfluidic device 100, respectively. FIG. 4 is a schematic cross sectional view of the microfluidic device 100.

In the illustrated examples of FIGS. 1-4, the microfluidic device 100 includes a plurality of layers 101 and has a top 102, a bottom 103, a front 104, a back 105, a first side 106, and a second side 107. In operation, the microfluidic device 100 is oriented such that the top 102 faces upwardly and the bottom 103 faces downwardly, with respect to the direction of gravity.

In the illustrated examples, the plurality of layers 101 includes a first layer 110, a second layer 120, a third layer 130, a fourth layer 140, and a fifth layer 150. The second layer 120 is between the first and third layers 110, 130. The third layer 130 is between the second and fourth layers 120, 140. The fourth layer 140 is between the third and fifth layers 130, 150. The second, third, and fourth layers 120, 130, 140 respectively define cutouts 320, 330, 340. The first and the fifth layers 110, 150 are solid.

When the layers 110, 120, 130, 140, 150 are stacked and fused together to form the microfluidic device 100, the microfluidic device 100 defines an internal void 160. It should be understood that the microfluidic device 100 may include any number of layers and the internal void 160 may be defined by any number of layers. The plurality of layers 101 may be composed from any suitable material for microfluidic applications (e.g., polyimide, polydimethylsiloxane (PDMS), etc.). The cutouts 320, 330, 340 may be formed by laser cutting.

The internal void 160 includes a cell settling channel 161, a cell transfer region 162, a cell output channel 163, a waste channel 164, a first input medium channel 165, and a second input medium channel 166. The cell settling channel 161, the cell output channel 163, the waste channel 164, the first input medium channel 165, and the second input medium channel 166 are generally rectangular in cross section.

The cell output channel 163 extends from and is in fluid communication with the cell transfer region 162. The cell output channel 163 is generally perpendicular to the cell settling channel 161 and the waste channel 164. The cell output channel 163 includes an upper portion 163*a* and a lower portion 163*b*. The upper portion 163*a* communicates with the cell transfer region 162, the lower portion 163*b*, and the first and second input medium channels 165, 166. The lower portion 163*b* includes a cell outlet 175. The lower portion 163*b* is offset relative to the cell transfer region 162 and to the waste channel 164. The cell output channel 163 communicates with the bottom 103 via the cell outlet 175.

More specifically, the first, second, third, fourth, and fifth layers 110, 120, 130, 140, 150 define the upper portion 163*a*. In other words, the cutouts 320, 330, 340 form the upper portion 163*a*. The first, second, and third layers 110, 120, 130 define the lower portion 163*b*. In other words, the cutout 320 forms the lower portion 163*b*. In operation, the cell output channel 163 carries cells 440 suspended in a mixture of first medium and input medium out of the microfluidic device 100. It should be understood that this mixture of first medium and input medium is referred to as a second medium.

The first input medium channel 165 includes a first entry portion 165*a*. The first input medium channel 165 extends from and is in fluid communication with the cell output channel 163 via the first entry portion 165*a*. In some examples, the first entry portion 165*a* extends nonperpendicularly away from the cell output channel 163 to form an acute angle with the upper portion 163*a* and an obtuse angle with the lower portion 163*b*. The first input medium channel 165 includes a first input medium inlet 171. The first input medium channel 165 communicates with the first side 106 via the first measure sample medium inlet 171.

More specifically, the first, second, and third layers 110, 120, 130 define the first input medium channel 165. In other words, the cutout 320 forms the first input medium channel 165. In operation, the first input medium channel 165 carries input medium to the cell output channel 163.

The second input medium channel 166 includes a second entry portion 166*a*. The second input medium channel 166 extends from and is in fluid communication with the cell output channel 163 via the second entry portion 166*a*. In some examples, the second entry portion 166*a* extends nonperpendicularly away from the cell output channel 163 to form and acute angle with the upper portion 163*a* and an obtuse angle with the lower portion 163*b*. The second input medium channel 166 includes a second input medium inlet 172. The second input medium channel 166 communicates with the second side 107 via the second input medium inlet 172. In some examples, the first and second input medium channels 165, 166 are opposite one another. In some examples, the second input medium channel 166 is omitted.

More specifically, the first, second, and third layers 110, 120, 130 define the second input medium channel 166. In other words, the cutout 320 forms the second input medium channel 166. In operation, the second input medium channel 166 carries input medium to the cell output channel 163.

The cell settling channel 161 extends from and is in fluid communication with the cell transfer region 162. The cell settling channel 161 communicates with the cell transfer region 162. The cell settling channel 161 includes a cell suspension inlet port 173. The cell settling channel 161 communicates with the first side 106 via the cell suspension inlet port 173. The cell settling channel 161 is offset relative to the cell transfer region 162. The cell settling channel 161 is offset relative to the waste channel 164.

More specifically, the first, second, and third layers 110, 120, 130 define the cell settling channel 161. In other words, the cutout 320 forms the cell settling channel 161. The cell settling channel 161 has a width a, a height b, and extends for at least a cell settling length D, as will be explained in greater detail below. In operation, the cell settling channel 161 carries a suspension of cells 440 suspended in first medium to the cell transfer region 162. The cells 440 settle to the bottom of the cell settling channel 161 as the cells 440 are carried from the cell suspension inlet port 173 to the cell transfer region 162, as will be explained in greater detail below.

The waste channel 164 extends from and is in fluid communication with the cell transfer region 162. The waste channel 164 communicates with the cell transfer region 162. The waste channel 164 includes a waste outlet 174. The waste channel 164 communicates with the second side 107 via the waste outlet 174. The waste channel 164 is offset relative to the cell transfer region 162.

More specifically, the third, fourth, and fifth layers 130, 140, 150 define the waste channel 164. In other words, the cutout 340 forms the waste channel 164. Thus, the waste channel 164 and the cell settling channel 161 are offset from one another. In operation, the waste channel 164 carries first medium out of the microfluidic device 100.

The cell transfer region 162 communicates with the cell settling channel 161, the cell output channel 163, and the waste channel 164. The cell transfer region 162 is larger in flow direction cross section than the cell settling channel 161, the cell output channel 163, and the waste channel 164. In other words, the cell transfer region 162 is an expansion of the internal void 160 between the cell settling channel 161, the cell output channel 163, and the waste channel 164. The cell transfer region 162 includes an upper region 162*a* and a lower region 162*b* that are in communication with one another. In operation, the cell transfer region 162 directs cells 440 and a first portion of the first medium to the cell output channel and directs a remaining second portion of the first medium to the waste channel 164, as will be explained in greater detail below.

More specifically, the cell transfer region 162 is defined by the first, second, third, fourth, and fifth layers 110, 120, 130, 140, 150. In other words, the cutouts 320, 330, 340 form the cell transfer region 162. Working together, the second, third, and fourth layers 120, 130, 140 form first and second slopes 410, 420 and one or more upper walls 430.

The first and second slopes define the lower region 162*b*. The cell settling channel 161 transitions into the cell output channel 163 via the first slope 410 of the cell transfer region 162. The waste channel 164 transitions into the cell output channel 163 via the second slope 420 of the cell transfer region 162. In other words, the cell transfer region 162 narrows into the cell output channel 163 via the first and second slopes 410, 420. In the illustrated embodiment, the first and second slopes 410, 420 are curved. It should be understood that the first and second slopes 410, 420 may be straight.

The upper walls 430 define the upper region 162*a*. In the illustrated embodiment, the upper region 162*a* is defined by three upper walls 430, which give the upper region 162*a* a trapezoidal shape. In other words, the cell transfer region 162 narrows into the cell settling channel 161 and into the waste channel 164 via the one or more of the upper walls 430. It should be understood that the upper region 162*a* may be defined by any number of upper walls 430 to be any shape including obtuse internal angles (e.g., pentagonal, hexagonal, heptagonal, etc.) and/or hemispherical. It should be appreciated that obtuse internal angles between the upper walls 430 substantially prevent eddies and/or recirculation spots as the first medium flows through the cell transfer region 162.

Referring now to FIG. 4, it should be understood that the cell settling channel 161 extends for at least a cell settling length D. In operation, as the first medium and the suspended cells 400 flow through the cell settling channel 161, the cells 440 move toward the bottom of the cell settling channel 161 due to the downward force of gravity g. In other words, the cell output channel 161 is configured to allow the cells 440 to fall from upper flow laminae to lower flow laminae of the first medium before arriving in the cell transfer region 162. For a given first medium flow rate, the cell settling length D provides the cells 440 enough time to settle to the bottom of the cell settling channel 161 before entering the cell transfer region 162. The cell settling length D is based on the vertical cell settling velocity $V_{set}$ of the cells 440 in the first medium and the laminar flow axial fluid velocity profile of the cell settling channel 161. Thus, the cell settling length D is dependent on the cell 440 density, the cell 440 diameter, the cross-sectional dimensions of the cell settling channel 161, and the first medium flow rate. The cell settling length D is determined using Equations 1-7, explained below.

The downward force $F_{grav}$ on a cell 440 suspended in fluid is given by Equation 1, where $r_c$ is the cell radius, $p_c$ is the cell density, ρw is the fluid density, and g is acceleration due to gravity.

$$F_{grav}=4/3\pi r_c^3(\rho_c-\rho_w)g \quad \text{Equation 1}$$

The drag force $F_{drag}$ for a spherical object (e.g., a cell 440) with velocity V passing through a fluid is approximated using Equation 2, where η is the fluid dynamic viscosity of the first medium.

$$F_{drag}=6\pi r_c\eta V \quad \text{Equation 2}$$

The downward force $F_{grav}$ is balanced with the drag force $F_{drag}$ to yield Equation 3 to estimate of the cell settling velocity $V_{set}$, taking the cell settling velocity $V_{set}$ as the velocity V.

$$V_{set} = \frac{2r_c^2(\rho_c - \rho_w)g}{9\eta}$$

Equation 3

The time $t_{set}$ required for a cell 440 with radius $r_c$ to settle from the top to the bottom of the cell settling channel 161 is given by Equation 4, where b is the height of the cell settling channel 161.

$$t_{set} = \frac{b - 2r_c}{V_{set}} \quad \text{Equation 4}$$

During time $t_{set}$, the cells 440 will be carried along the cell settling channel 161 by the laminar flow of the surrounding first medium fluid, which will determine the minimum settling length D required to allow each cell 440 to completely settle before reaching the cell transfer region. Laminar flow in direction z at height y and width x in the rectangular cell settling channel 161 is described by Equation 5, where a is the width the of the cell setting channel 161, and $V_{max}$ is the maximum flow rate of the first medium.

$$V_z(x, y) \approx V_{max}\frac{x(a-x)y(b-y)}{a^2b^2/16} \quad \text{Equation 5}$$

How far a cell 440 will travel along the cell settling channel 161 as it settles from the top to the bottom of the cell settling channel is given by Equations 6 and 7.

$$D = \int_0^{t_{set}} V_z\left(x = \frac{a}{2}, y(t)\right)dt$$

Equation 6, where $$y(t)=b-r_c-tV_{set} \quad \text{Equation 7}$$

In the illustrated examples of FIGS. 1-4, the cell settling length D is approximately 2 centimeters. It should be understood and appreciated that the cell settling length D is dependent on the size and density of the cells, the density and viscosity of the first medium, and the dimensions of the cell settling channel 161, as explained above. The microfluidic device 100 may be constructed to have any cell settling length D.

Referring again to FIG. 4, the cell transfer region 162 is designed to receive cells 440 suspended in the first medium from the cell settling channel 161, deliver most of the cells 440 with a minimum amount of first medium to the cell output channel 163, and deliver the remaining first medium to the waste channel 164. The geometry of the cell transfer region 162 creates a path of least flow resistance for the lowest laminae of the input first medium and suspended cells 440 to the cell output channel 163. Conversely, the upper laminae of the first medium have a path of least resistance to the waste channel 164. In other words, the cell transfer region 162 is configured to divert lower flow laminae of the first medium from the cell settling channel 161 to the cell output channel 163 and to divert upper flow laminae of the first medium from the cell settling channel 161 to the waste channel 164. The relative amounts of fluid delivered to the waste channel 164 and the cell output channel 163 is determined by back pressure applied to the waste channel 164. In some embodiments, additional settling of the cells 440 while traversing the region allows the cells 440 to cross to lower laminae than the laminae in which the cells 440 entered the cell transfer region 162. This additional settling can further enhance the efficiency of transfer of cells 440 into the cell output channel 163.

Systems for Gravimetric Cell Transfer

As another aspect of the present invention, the present methods and apparatus are provided as a system for gravimetric transfer of cells from a first medium to a second medium. The system includes a microfluidic device as described herein. The system can also include one or more instruments configured for metabolic or other measurements of a cell population, one or more sensors used to determine salinity of the fluid mixture used with the instrument(s), fluid-moving components (e.g., pumps, regulators, valves, etc.), and a controller to control the fluid-moving components.

Figure 5:
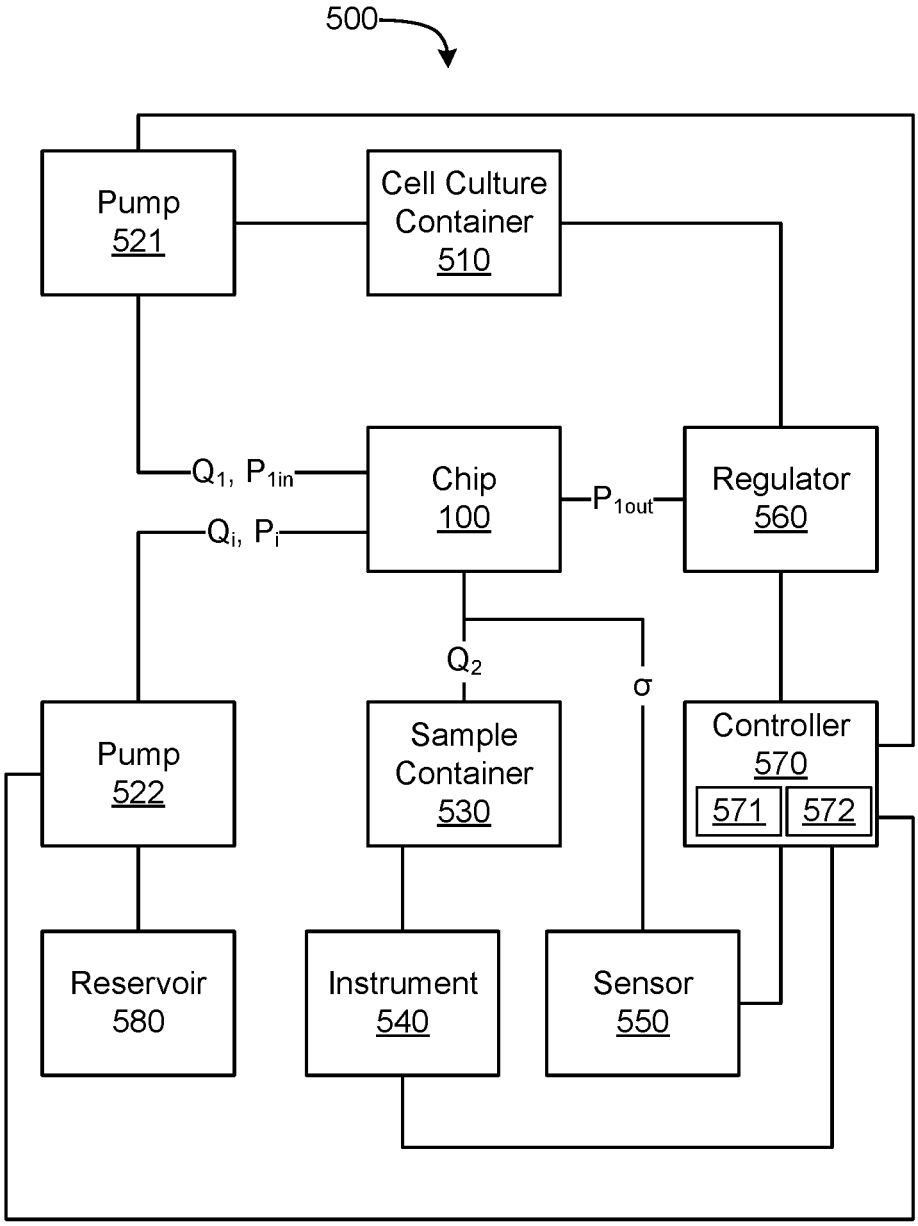
FIG. 5 is a block diagram of a cell transfer system including the microfluidic device of FIG. 1.

FIG. 5 is a block diagram of a cell transfer system 500 including the microfluidic device 100. In addition to the microfluidic device 100, the cell transfer system 500 includes a cell culture container 510, a first pump 521, a second pump 522, a sample container 530, an instrument 540, a sensor 550, a regulator 560, a controller 570, and a reservoir 580. The first pump 521, the second pump 522, and the regulator 560 may be collectively referred to as fluid-moving components of the system 500.

The cell culture container 510 is in fluid communication with the first pump 521 and with the regulator 560. The cell culture container 510 stores cell suspension. It should be understood that cell suspension comprises cells (e.g., the cells 440) suspended in first medium.

The first pump 521 is in fluid communication with the cell culture container 510 and with the microfluidic device 100. The first pump 521 is in electrical communication with the controller 570. The first pump 521 pumps cell suspension from the cell culture container 510 into the cell settling channel 161 of the microfluidic device 100, shown in FIGS. 1, 3A, and 4. The first pump 521 determines the flow rate $Q_1$ and the input pressure $P_{1in}$ of the cell suspension as the cell suspension is being pumped into the microfluidic device 100. The first pump 521 reports the flow rate $Q_1$ and the input pressure $P_{1in}$ values to the controller 570.

The second pump 522 is in fluid communication with the reservoir 580 and with the microfluidic device 100. The second pump 522 is in electrical communication with the controller 570. The second pump 522 pumps input medium from the reservoir 580 into the first and second input medium channels 165, 166 of the microfluidic device 100, shown in FIGS. 1, 3A, and 4. The second pump 522 determines the flow rate $Q_1$ and the input pressure $P_i$ of the input medium as the input medium is being pumped into the microfluidic device 100. The second pump 522 reports the flow rate $Q_1$ and the input pressure $P_i$ values to the controller 570.

The sample container 530 is in fluid communication with the second pump 522 and with the instrument 540. The sample container 530 stores the second medium, which is a mixture of input medium and first medium. In some examples, the instrument 540 includes the sample container 530. In some examples, components of the instrument 540 are housed in the sample container 530. In operation, the sample container 530 stores cells (e.g., the cells 440) suspended in second medium. It should be understood that the amount of first medium stored in the sample container is small as compared to the amount of input medium. The sample container 530 can house or perform other functions, such as cell lysis or other processing.

The instrument 540 is in fluid communication with the sample container 530 and, in some examples, in electrical communication with the controller 570. In some examples, the instrument 540 is in electrical communication with a computer (not shown). The instrument 540 analyses the cells stored in the sample container 530. In some examples, the instrument 540 is a mass spectrometer. It should be understood that the system 500 may include additional components (not shown) between the sample container 530 and the instrument 540 to prepare the cells for analysis by the instrument 540.

The sensor 550 is in fluid communication with the microfluidic device 100 and/or with the sample container 530. The sensor 550 is in electrical communication with the controller 570. In some examples, the sensor 550 senses electrical conductivity a of the second medium—the first medium and input medium mixture—flowing out of the cell output channel 163, shown in FIGS. 1, 3A, and 4. The sensor 550 reports the electrical conductivity a value to the controller 570. It should be understood that the electrical conductivity of the second medium is indicative of the salinity of the second medium in the cell output channel 163.

The regulator 560 is in fluid communication with the microfluidic device 100 and with the cell culture container 510. The regulator 560 is in electrical communication with the controller 570. The regulator 560 measures and regulates the output pressure of the first medium $P_{1out}$ flowing out of the waste channel 164 of the microfluidic device 100, shown in FIGS. 1, 3C, and 4. It should be understood that first medium output pressure $P_{1out}$ is the pressure difference between the waste channel 164 and the cell output channel 161. The first medium output pressure $P_{1out}$ may be referred to as back pressure. The regulator 560 is adjustable to maintain different back pressures $P_{1out}$ in the waste channel 164. The regulator 560 reports the first medium output pressure $P_{1out}$ value to the controller 570.

The reservoir 580 is in fluid communication with the second pump 522. The reservoir 580 stores input medium that is compatible for use with the instrument 540.

The controller 570 comprises a processor 571 and memory 572. The controller 570 is in electrical communication with, receives data from, and/or sends commands to the first pump 521, the second pump 522, the instrument 540, the sensor 550, and the regulator 560. The controller 570 receives the cell suspension flow rate $Q_1$ and input pressure $P_{1in}$, the input medium flow rate $Q_1$ and input pressure $P_i$, the electrical conductivity σ, and the first medium output pressure $P_{1out}$. The controller 570, using the processor 571, controls the first pump 521 to pump cell suspension to the microfluidic device 100 at a first flow rate. The controller 570, using the processor 571, controls the second pump 522 to pump input medium to the microfluidic device 100 at a second flow rate. The controller 570, using the processor 571, determines a ratio of the first medium to the input medium in the second medium flowing out of the cell output channel 163 based on the electrical conductivity σ. The controller 570, using the processor 571, compares the determined ratio to upper and lower limits of a predetermined range (e.g., 2 to 9 millimolar, etc.) stored in the memory 572. The controller 570, using the processor 571, commands the regulator 560 open or close to adjust the first medium output pressure $P_{1out}$ based on the comparison between the determined ratio and the predetermined range.

For example, where the determined ratio is above the upper limit (e.g., the second medium exiting the cell output channel 163 is too saline), the controller 570 commands the regulator 560 to open to decrease the first medium output pressure $P_{1out}$. Decreasing the first medium output pressure $P_{1out}$ diverts less cell suspension to the cell output channel 163 from the cell settling chamber 161. As mentioned above, the instrument 540 may not produce accurate measurements if the mixture in the sample container is too saline.

For example, where the determined ratio is below the lower limit (e.g., the second medium exiting the cell output channel 163 lacks salt), the controller 570 commands the regulator 560 to constrict to increase the first medium output pressure $P_{1out}$. Increasing the first medium output pressure $P_{1out}$ diverts more cell suspension to the cell output channel 163 from the cell settling chamber 161. It should be understood that, despite the sensitivity of the instrument 540, a too-low salinity mixture in the sample container 530 may indicate that no or too few cells have been transferred from the first medium to the sample container 530.

It should be understood and appreciated that the ability to independently set the feeding flow rates $Q_{1in}$ and $Q_1$ and to regulate the first medium output pressure $P_{1out}$ via the controller 570 permits independent control of the flow rate of the second medium $Q_2$ exiting the cell output channel 163, of the ratio of the first medium to the input medium in the second medium exiting the cell output channel 163, and of the ratio of first medium that exits via the waste channel 164 to the first medium that exits via the cell output channel 163.

Methods for Gravimetrically Transferring Cells

Figure 6:
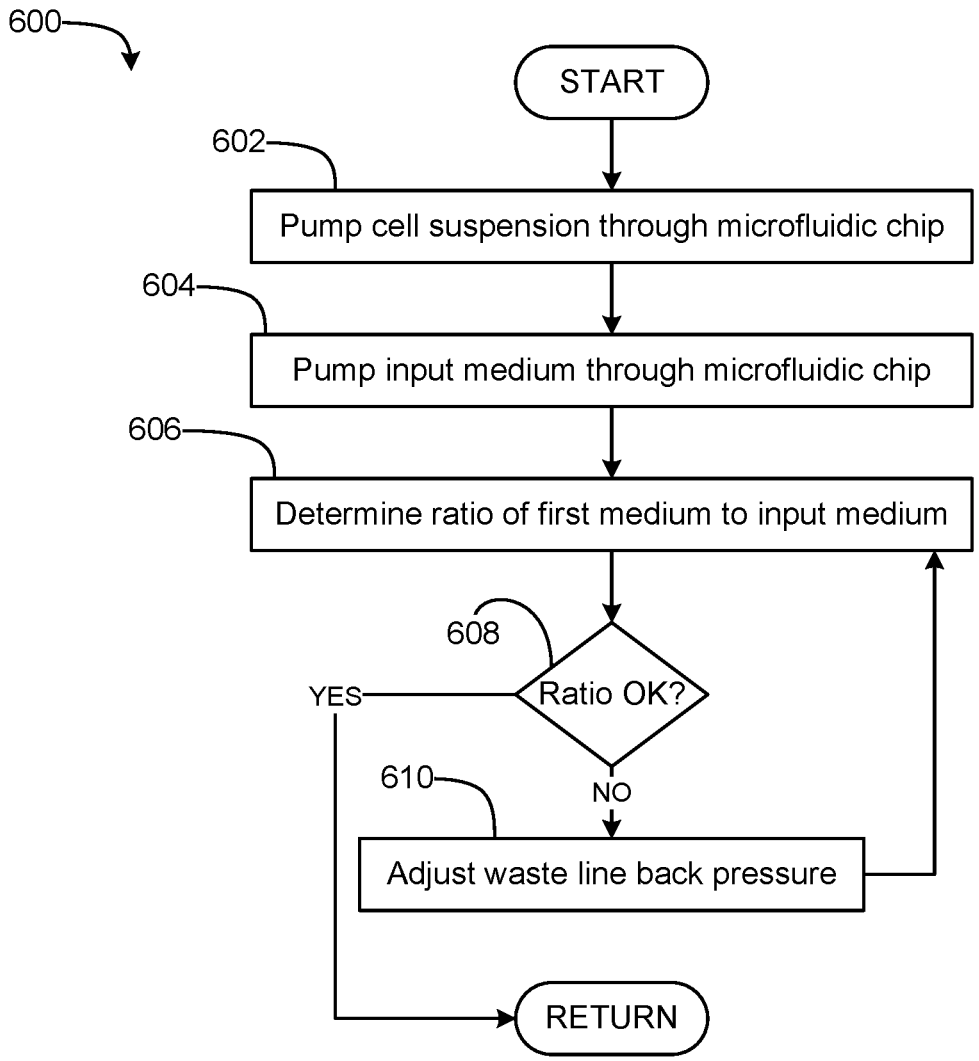
FIG. 6 is a flowchart of a method to transfer living cells from a cell culture medium to a sample medium, which may be implemented by the system of FIG. 5.

As another aspect of the present invention, a method is provided for gravimetrically transferring cells from a first medium to a second medium. FIG. 6 is a flowchart of a method to transfer living cells from a first medium to a second medium, which may be implemented by the system of FIG. 5. The flowchart of FIG. 6 is representative of machine readable instructions stored in memory (such as the memory 572 of FIG. 5) that comprise one or more programs that, when executed by a processor (such as the processor 571 of FIG. 5), cause the controller 570 to operate the fluid-moving components of FIG. 5 to gravimetrically transfer cells from the first medium to the second medium via the microfluidic device 100. Further, although the example program(s) is/are described with reference to the flowchart illustrated in FIG. 6, many other methods to gravimetrically transfer cells from the first medium to the second medium via the microfluidic device 100 may alternatively be used. For example, the order of execution of the blocks may be changed, and/or some of the blocks described may be changed, eliminated, or combined.

Referring to FIG. 6, initially, at block 602, the controller 570 commands the first pump 521 to pump cell suspension from the cell culture container 510 to the microfluidic device 100 at a first predetermined flow rate. As described above, the first pump 521 senses and reports the actual cell suspension flow rate $Q_{1in}$ and pressure $P_{1in}$ values to the controller 570.

At block 604, the controller 570 commands the second pump 522 to pump input medium from the reservoir 580 to the microfluidic device 100 at a second predetermined flow rate. As described above, the second pump 522 senses and reports the actual input medium flow rate $Q_i$ and pressure $P_i$ values to the controller 570

At block 606, the controller 570 determines a ratio of the first medium to the input medium in the second medium mixture based on the electrical conductivity a of the second medium in the cell output channel 163. As described above, the sensor 550 senses and reports the actual fluid mixture electrical conductivity a value to the controller 570.

At block 608, the controller 570 determines whether the ratio of the first medium to the input medium is within a predetermined range.

If, at block 608, the controller 570 determines that the ratio of the first medium to the input medium is outside (e.g., not within) the predetermined range, the method 600 proceeds to block 610.

At block 610, the controller 570 commands the regulator 560 to adjust the back pressure $P_{1out}$ of the first medium. More specifically, where the salinity is above the range, the regulator 560 opens to allow more first medium to flow out of the waste channel 164. Where the salinity is below the range, the regulator 560 constricts the flow of the first medium out of the waste channel 164.

If, at block 608, the controller 570 determines that the ratio of the first medium to the input medium is within the predetermined range, the method 600 returns to block 602.

EXEMPLARY EMBODIMENTS

Embodiment 1

A microfluidic device for gravimetrically transferring cells from a first medium to an input medium, the microfluidic device comprising: a cell transfer region; a cell settling channel extending from and in fluid communication with the cell transfer region, the cell settling channel being smaller in cross section than the cell transfer region; a waste channel extending from and in fluid communication with the cell transfer region, the waste channel being smaller in cross section than the cell transfer region; a cell output channel extending downwardly from and in fluid communication with the cell transfer region such that cells in the cell transfer region fall into the cell output channel via gravity, the cell output channel being smaller in cross section than the cell transfer region and substantially perpendicular to the cell settling channel and to the waste channel; an input medium channel extending from and in fluid communication with the cell output channel.

Embodiment 2

The microfluidic device of embodiment 1, wherein the input medium channel is a first input medium channel and further comprising a second input medium channel extending from and in fluid communication with the cell output channel.

Embodiment 3

The microfluidic device of embodiment 2, wherein the first and second input medium channels are opposite one another.

Embodiment 4

The microfluidic device of any of the foregoing embodiments, wherein the input medium channel comprises an entry portion, the entry portion being nonperpendicular relative to the cell output channel.

Embodiment 5

The microfluidic device of any of the foregoing embodiments, wherein the cell settling channel and the waste channel are opposite one another.

Embodiment 6

The microfluidic device of any of the foregoing embodiments, wherein the cell settling channel and the waste channel are offset relative to the cell transfer region and to one another.

Embodiment 7

The microfluidic device of any of the foregoing embodiments, wherein the cell settling channel extends for at least a cell settling length.

Embodiment 8

The microfluidic device of any of the foregoing embodiments, wherein the cell transfer region is configured to divert lower flow laminae of the first medium from the cell settling channel to the cell output channel; and divert upper flow laminae of the first medium from the cell settling channel to the waste channel.

Embodiment 9

The microfluidic device of embodiment 8, wherein the cell settling channel is configured to allow cells to fall from the upper flow laminae to the lower flow laminae before arriving in the cell transfer region.

Embodiment 10

A system for gravimetric transfer of cells from a first medium to a second medium, the system comprising: a microfluidic device comprising: a cell transfer region, a cell settling channel extending from and in fluid communication with the cell transfer region, the cell settling channel being smaller in cross section than the cell transfer region, a waste channel extending from and in fluid communication with the cell transfer region, the waste channel being smaller in cross section than the cell transfer region, a cell output channel extending downwardly from and in fluid communication with the cell transfer region such that cells in the cell transfer region fall into the cell output channel via gravity, the cell output channel being smaller in cross section than the cell transfer region and substantially perpendicular to the cell settling channel and to the waste channel, an input medium channel extending from and in fluid communication with the cell output channel; a sensor configured to generate an electrical conductivity value of the second medium in the cell output channel, the second medium being a mixture of the first medium and an input medium; a regulator configured to adjust back pressure of the first medium in the waste channel; and a controller configured to control the regulator based on the electrical conductivity value.

Embodiment 11

The system of embodiment 10, wherein the controller is configured to receive the electrical conductivity value from the sensor; determine a ratio value of the first medium to the input medium in the cell output channel based on the electrical conductivity; and determine whether the ratio value is within a predetermined range.

Embodiment 12

The system of embodiment 11, wherein the predetermined range has an upper limit and a lower limit and the controller is configured to if the ratio value exceeds the upper limit, open the regulator; and if the ratio value is below the lower limit, constrict the regulator.

Embodiment 13

The system of any of embodiments 10 to 12, further comprising a cell culture container to store cells suspended in the first medium; a first pump in fluid communication with the microfluidic device and the cell culture container to pump the cells and the first medium from the cell culture container to the microfluidic device; a reservoir to store the input medium; and a second pump in fluid communication with the microfluidic device and the reservoir to pump the input medium from the reservoir to the microfluidic device.

Embodiment 14

The system of embodiment 13, wherein the controller is configured to control the first and second pumps.

Embodiment 15

The system of embodiment 13, wherein the regulator is in fluid communication with the cell culture container to return first medium from the waste channel to the cell culture container.

Embodiment 16

The system of any of embodiments 10 to 15, wherein the cell transfer region is configured to divert lower flow laminae of the first medium from the cell settling channel to the cell output channel; and divert upper flow laminae of the first medium from the cell settling channel to the waste channel.

Embodiment 17

The system of embodiment 10, wherein the cell settling channel is configured to allow cells to fall from the upper flow laminae to the lower flow laminae before arriving in the cell transfer region.

Embodiment 18

A method for gravimetrically transferring cells from a first medium to a second medium, the method comprising the steps of: pumping, with a first pump, a suspension of cells suspended in a first medium into a cell settling channel of a microfluidic device; pumping, with a second pump, an input medium into an input medium channel of the microfluidic device; sensing, with a sensor, an electrical conductivity of the second medium in a cell output channel of the microfluidic device, the second medium being a mixture of the first medium and the input medium; determining, with a processor, a ratio of the first medium to the input medium in the cell output channel based on the electrical conductivity; adjusting, with a regulator, a back pressure of the first medium in a waste channel of the microfluidic device based on the ratio.

Embodiment 19

The method of embodiment 18, wherein adjusting the back pressure of the first medium in the waste channel comprises determining, with the processor, whether the ratio is within a predetermined range.

Embodiment 20

The method of embodiment 19, wherein the predetermined range has an upper limit and a lower limit and adjusting the back pressure of the first medium in the waste channel comprises opening the regulator if the ratio value exceeds the upper limit; and constricting the regulator if the ratio value is below the lower limit.

Embodiment 21

The microfluidic device of any of embodiments 1 to 9, wherein: a sensor is in fluid communication with the cell output channel, the sensor being configured to generate an electrical conductivity value of a second medium in the cell output channel, the second medium being a mixture of the first medium and the input medium; a regulator is in fluid communication with the waste channel, the regulator being configured to adjust back pressure of the first medium in the waste channel; and a controller is in communication with the sensor and with the regulator, the controller being configured to control the regulator based on the electrical conductivity value.

Embodiment 22

The microfluidic device of embodiment 21, wherein the controller is configured to: receive the electrical conductivity value from the sensor; determine a ratio value of the first medium to the input medium in the cell output channel based on the electrical conductivity;

and determine whether the ratio value is within a predetermined range.

Embodiment 23

The microfluidic device of embodiment 22, wherein the predetermined range has an upper limit and a lower limit and the controller is configured to: if the ratio value exceeds the upper limit, open the regulator; and if the ratio value is below the lower limit, constrict the regulator.

Embodiment 24

The microfluidic device of any of embodiments 21 to 23, wherein: a first pump is in fluid communication with the cell settling channel and a cell culture container, the cell culture container being configured to store cells suspended in the first medium and the first pump being configured to pump the cells and the first medium from the cell culture container to the cell settling channel; and a second pump is in fluid communication with the input medium channel and a reservoir, the reservoir being configured to store the input medium and the second pump being configured to pump the input medium from the reservoir to the microfluidic device.

Embodiment 25

The microfluidic device of embodiment 24, wherein the controller is in communication with the first and second pumps and is configured to control the first and second pumps.

Embodiment 26

The microfluidic device of embodiment 24, wherein the regulator is in fluid communication with the cell culture container to return first medium from the waste channel to the cell culture container.

Embodiment 27

The microfluidic device of any of embodiments 21 to 26, wherein the cell transfer region is configured to: divert lower flow laminae of the first medium from the cell settling channel to the cell output channel; and divert upper flow laminae of the first medium from the cell settling channel to the waste channel.

Embodiment 28

The microfluidic device of any of embodiments 21 to 27, wherein the cell settling channel is configured to allow cells to fall from the upper flow laminae to the lower flow laminae before arriving in the cell transfer region.

In view of this disclosure it is noted that the methods and apparatus can be implemented in keeping with the present teachings. Further, the various components, materials, structures and parameters are included by way of illustration and example only and not in any limiting sense. In view of this disclosure, the present teachings can be implemented in other applications and components, materials, structures and equipment to implement these applications can be determined, while remaining within the scope of the appended claims.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or." The terms "includes," "including," and "include" are inclusive and have the same scope as "comprises," "comprising," and "comprise" respectively.

From the foregoing, it should be appreciated that the above disclosed apparatus and methods may provide gravimetric transfer of living cells from a first medium to an input medium compatible with an instrument. By injecting a cell suspension into a microfluidic device where suspended cells settle into bottom flow laminae, injecting a co-flowing input medium into the microfluidic device, and adjusting back pressure of outflowing cell suspension upper flow laminae to divert the cell-containing bottom flow laminae into the input medium, living cells may be more easily transferred from a first medium to the input medium. Thus, more accurate measurements may be made of the living cells. It should also be appreciated that the disclosed apparatus and methods provide a specific solution—quickly moving living cells from a first medium to an input medium—to specific problems—incompatibility of measurement instruments with cell media used to keep cells alive and inaccurate measurements made on dying cells in measurement sample media.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

We claim:

1. A microfluidic device for gravimetrically transferring cells from a first medium to an input medium, the microfluidic device comprising:

a cell transfer region;

a cell settling channel extending from and in fluid communication with the cell transfer region, the cell settling channel being smaller in cross section than the cell transfer region;

a waste channel extending from and in fluid communication with the cell transfer region, the waste channel being smaller in cross section than the cell transfer region;

a cell output channel extending downwardly from and in fluid communication with the cell transfer region such that cells in the cell transfer region fall into the cell output channel via gravity, the cell output channel being smaller in cross section than the cell transfer region and substantially perpendicular to the cell settling channel and to the waste channel;

an input medium channel extending from and in fluid communication with the cell output channel.

2. The microfluidic device of claim 1, wherein the input medium channel is a first input medium channel and further comprising a second input medium channel extending from and in fluid communication with the cell output channel.

3. The microfluidic device of claim 2, wherein the first and second input medium channels are opposite one another.

4. The microfluidic device of claim 1, wherein the input medium channel comprises an entry portion, the entry portion being nonperpendicular relative to the cell output channel.

5. The microfluidic device of claim 1, wherein the cell settling channel and the waste channel are opposite one another.

6. The microfluidic device of claim 1, wherein the cell settling channel and the waste channel are offset relative to the cell transfer region and to one another.

7. The microfluidic device of claim 1, wherein the cell settling channel extends for at least a cell settling length.

8. The microfluidic device of claim 1, wherein the cell transfer region is configured to divert lower flow laminae of the first medium from the cell settling channel to the cell output channel; and divert upper flow laminae of the first medium from the cell settling channel to the waste channel.

9. The microfluidic device of claim 8, wherein the cell settling channel is configured to allow cells to fall from the upper flow laminae to the lower flow laminae before arriving in the cell transfer region.

10. The microfluidic device of claim 1, wherein:

a sensor is in fluid communication with the cell output channel, the sensor being configured to generate an electrical conductivity value of a second medium in the cell output channel, the second medium being a mixture of the first medium and the input medium;

a regulator is in fluid communication with the waste channel, the regulator being configured to adjust back pressure of the first medium in the waste channel; and a controller is in communication with the sensor and with the regulator, the controller being configured to control the regulator based on the electrical conductivity value.

11. The microfluidic device of claim 10, wherein the controller is configured to:

receive the electrical conductivity value from the sensor;

determine a ratio value of the first medium to the input medium in the cell output channel based on the electrical conductivity; and determine whether the ratio value is within a predetermined range.

12. The microfluidic device of claim 11, wherein the predetermined range has an upper limit and a lower limit and the controller is configured to:

if the ratio value exceeds the upper limit, open the regulator; and if the ratio value is below the lower limit, constrict the regulator.

13. The microfluidic device of claim 10, wherein:

a first pump is in fluid communication with the cell settling channel and a cell culture container, the cell culture container being configured to store cells suspended in the first medium and the first pump being configured to pump the cells and the first medium from the cell culture container to the cell settling channel;

a second pump is in fluid communication with the input medium channel and a reservoir, the reservoir being configured to store the input medium and the second pump being configured to pump the input medium from the reservoir to the microfluidic device.

14. The microfluidic device of claim 13, wherein the controller is in communication with the first and second pumps and is configured to control the first and second pumps.

15. The microfluidic device of claim 13, wherein the regulator is in fluid communication with the cell culture container to return first medium from the waste channel to the cell culture container.

16. The microfluidic device of claim 10, wherein the cell transfer region is configured to:

divert lower flow laminae of the first medium from the cell settling channel to the cell output channel; and divert upper flow laminae of the first medium from the cell settling channel to the waste channel.

17. The microfluidic device of claim 16, wherein the cell settling channel is configured to allow cells to fall from the upper flow laminae to the lower flow laminae before arriving in the cell transfer region.

18. A method for gravimetrically transferring cells from a first medium to a second medium, the method comprising the steps of:

pumping, with a first pump, a suspension of cells suspended in a first medium into a cell settling channel of a microfluidic device;

pumping, with a second pump, an input medium into an input medium channel of the microfluidic device;

sensing, with a sensor, an electrical conductivity of the second medium in a cell output channel of the microfluidic device, the second medium being a mixture of the first medium and the input medium;

determining, with a processor, a ratio of the first medium to the input medium in the cell output channel based on the electrical conductivity;

adjusting, with a regulator, a back pressure of the first medium in a waste channel of the microfluidic device based on the ratio.

19. The method of claim 18, wherein adjusting the back pressure of the first medium in the waste channel comprises determining, with the processor, whether the ratio is within a predetermined range.

20. The method of claim 19, wherein the predetermined range has an upper limit and a lower limit and adjusting the back pressure of the first medium in the waste channel comprises opening the regulator if the ratio value exceeds the upper limit; and constricting the regulator if the ratio value is below the lower limit.

* * * * *